US005174576A

United States Patent [19]

Lee et al.

[11] Patent Number: 5,174,576

[45] Date of Patent: Dec. 29, 1992

[54] PORTABLE GOLF PRACTICE MIRROR

[76] Inventors: Kevin S. Lee, 553 S. St. Andrews Pl., #107, Los Angeles, Calif. 90020; Steve D. Park, 9218 Otto St., Downey, Calif. 90240; Scott Ganaja, 2011 Morgan La., Redondo Beach, Calif. 90278

[21] Appl. No.: 835,315

[22] Filed: Feb. 14, 1992

[51] Int. Cl.[5] ..... A63B 69/36

[52] U.S. Cl. ..... 273/187.6; 273/35 A; 273/187 A; 359/838; 359/871; 359/882

[58] Field of Search ..... 359/838, 860, 872, 871, 359/882; 273/35 A, 35 R, 183 E, 187 R, 187 A, 183 R, 183 A

[56] References Cited

U.S. PATENT DOCUMENTS 546,195 9/1895 Sharp ..... 359/882
1,099,820 6/1914 Ritings ..... 359/871 X
4,383,687 5/1983 Wolff ..... 273/35 A
5,116,058 5/1992 Theriault ..... 273/35 A X

FOREIGN PATENT DOCUMENTS 2130103 5/1984 United Kingdom ..... 273/35 A

*Primary Examiner*—George J. Marlo
*Attorney, Agent, or Firm*—Albert O. Cota

[57] ABSTRACT

A portable mirror apparatus for a golfer to view his swing which has a U-shaped hollow tubular frame (20) with cross bars (34), (36) and (38) inbetween, also divided in the middle and a mirror (40) attached on the front. A pair of retracting legs (48) support the invention in the vertical position each having a support bar (52) for stiffening. The invention folds in the middle for transportation and storage with the legs pivoted inward contiguous with the frame. The mirror contains marks in the form of lines (42) both horizontal and vertical to indicate proper alignment of the golfer during the swing of a golf club. The mirror is thermoplastic for strength and durability, also to reduce weight.

15 Claims, 2 Drawing Sheets

PORTABLE GOLF PRACTICE MIRROR

TECHNICAL FIELD

The present invention relates to practice devices for the game of golf in general. More specifically to a portable mirror, that has lines, allowing observation of a golfer's swing relative to specific orientations.

BACKGROUND ART

Previously, many types of mirrors have been used in endeavoring to provide an effective means of training for the game of golf specifically during the swing of a golf club. In most cases, prior art employs a reflective device of some sort, including convex mirrors, sectionalized mirrors and combinations of round or square mirrors. Some inventions superimpose images on the mirrors and others use pictures on, or near, a mirror for comparative purposes.

A search of the prior art did not disclose any patents that read directly on the claims of the instant invention however, the following U.S. patents were considered related:

| U.S. Pat. No. | INVENTOR | ISSUED |
|---|---|---|
| 4,383,687 | Wolff | 17 May 1983 |
| 3,917,278 | Steinman Jr. | 4 November 1975 |
| 3,915,457 | Casey | 28 October 1975 |
| 3,110,495 | Carter | 12 November 1963 |
| 3,000,261 | Frenkel | 19 September 1961 |
| 1,558,762 | Richter | 27 October 1925 |
| 1,410,811 | Lewis | 28 March 1922 |
| Des. 198,459 | Blythe Jr. | 16 June 1964 |

Wolff in U.S. Pat. No. 4,383,687 teaches carpet on which an orientable flap pivotally mounts a convex mirror, including a strut, that holds the mirror at different inclinations. In use, a golfer views himself while addressing the ball positioned on the carpet in front of the mirror.

U.S. Pat. No. 3,917,278 issued to Steinman, Jr. employs an adjustable convex mirror supported by a tripod. Horizontal and vertical lines are marked on the mirror to coincide with the axis of rotation of the golfer's body during the golfer's swing.

Casey discloses a mirror and transparent sheet with superimposed images in U.S. Pat. No. 3,915,457. A stand supports the juxtaposed devices allowing the user to view his own reflection and images simultaneously.

Carter in U.S. Pat. No. 3,110,495 uses separately mounted mirrors disposed near a golf tee arranged such that his entire image is visible enabling him to study his position and movements while addressing and hitting the ball.

U.S. Pat. No. 3,000,261 of Frenkel employs an upright casing with an eye for receiving the player's image. An optical system includes a pair of angled mirrors with the eye reducing the size of the user's image to permit complete self observation in a relatively small area. The device is foldable for transportation.

Richter in U.S. Pat. No. 1,558,762 uses mirrors positioned to see his own image juxtapositioned with pictures arranged to illustrate correct postures for successive movements.

U.S. Pat. No. 1,410,811 of Lewis in 1922 employs a mirror suspended in front of a golfer displaying pictures, diagrams of photographs of correct positions. A mirror with vertical and horizontal lines is placed in front of the images of observation simultaneously.

U.S. Pat. No. 198,459 illustrates a convex mirror with lines and support legs.

It will be noted that most prior art reduces the size of the mirror by lenses or convex shapes also images of superimposed on the surface.

DISCLOSURE OF THE INVENTION

Body alignment, prior to and during, the swing of golf club is extremely important in developing skills as a golfer. The problem arises when the sportsman is unable to visualize his or her own form and henceforth, develops bad habits that effect the game. Prior art has attempted to provide this visualization through convex mirrors and the like, however distortion and small images also complex photographs and diagrams confuse the issue and can turn the attention of the athlete to other things instead of the needed concentration on the basic form. It is therefore a primary object of the invention to provide a flat mirror large enough to see one's reflection in full size with minimal distortion and distraction.

An important object provides the golfer with a sturdy and durable mirror made of a thermoplastic material, such as acrylic, that may be transported and set up without the fear of breakage and the dangers involved with conventional glass mirrors.

Further, another object provides a number of simple lines marked on the mirror in a vertical and horizontal direction to permit golfers to align their body in the proper direction without unnecessary detail. This simple procedure does not require complex directions as the player inherently understands the principles but attempts through their own observations to detect faults and to optimize their swing.

Still another object is directed to the compactness of the mirror as even though it is large enough to see their entire body, the device folds in half and flat, permitting easy transportation in the trunk of a car and storage in a closet. This compactness is advantageous to the seller as well as the user by not taking unnecessarily large space to store and display the invention, although its large size when deployed is one of its most desirable features.

Yet another object of the invention is its weight as it is preferably made of plastic and hollow aluminum tubing both of which are optimum for their weight to strength ratio and are ideally suited for fabrication of this device. The lightweight structure allows easy carrying by the player to the site, and its study features and east of set up enhance its utility.

A final object allows the addition of optional features to be added without detracting from its use. Hooks for storing golf bags may be easily mounted on the frame in various configurations. A golf ball tray may be conveniently appended to the invention permitting the player to store balls during its use, such as on a driving range or where practice takes place. Further, a handle may be attached to the frame for ease of carrying after the apparatus has been folded up.

These and other objects and advantages of the present invention will become apparent from the subsequent detailed description of the preferred embodiment and the claims taken in conjunction with the accompanying drawings.

BEST MODE FOR CARRYING OUT THE INVENTION

Figure 1:
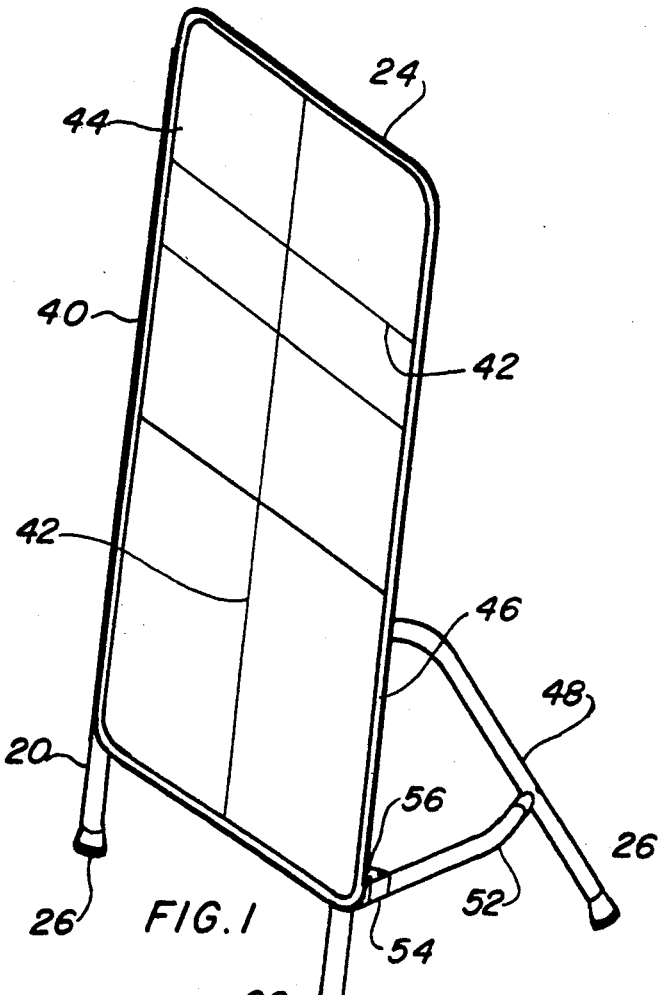
FIG. 1 is a partial isometric view of the preferred embodiment in its open fully deployed position.

The best mode for carrying out the invention is presented in terms of a preferred embodiment that allows golfers to directly view their form and stance prior to, during and after hitting the golf ball.

The preferred embodiment as shown in FIGS. 1 through 11 is comprised of a u-shaped frame 20 that has vertical sides forming support legs 22 and a horizontal top 24 connecting the legs together completing the u-shape. The frame support legs include rubber tips 26 on the bottom for the purpose of providing a non-slip surface. Hinge means are included integrally contained within each side permitting the frame 20 to be folded in half in the middle. The hinge means consists of a pair of hinge leaves 28 with a connecting pin 30 and a split sliding sleeve 32 that slips over the frame 20 as shown in FIGS. 5 through 8.

To operate the hinge, the sleeve 32 is slipped upward away from the joint allowing the hinge leaves 28 to pivot on the pin 30 and is held away from the joint by gravity. When the frame is rotated upward to its extended position, the sleeve 32 slips over the hinge and is again held in place by gravity. The structure of the sleeve 32 retains the joint in its connected position by completely covering both ends thereby becoming an extension of the frame members themselves.

Figure 8:
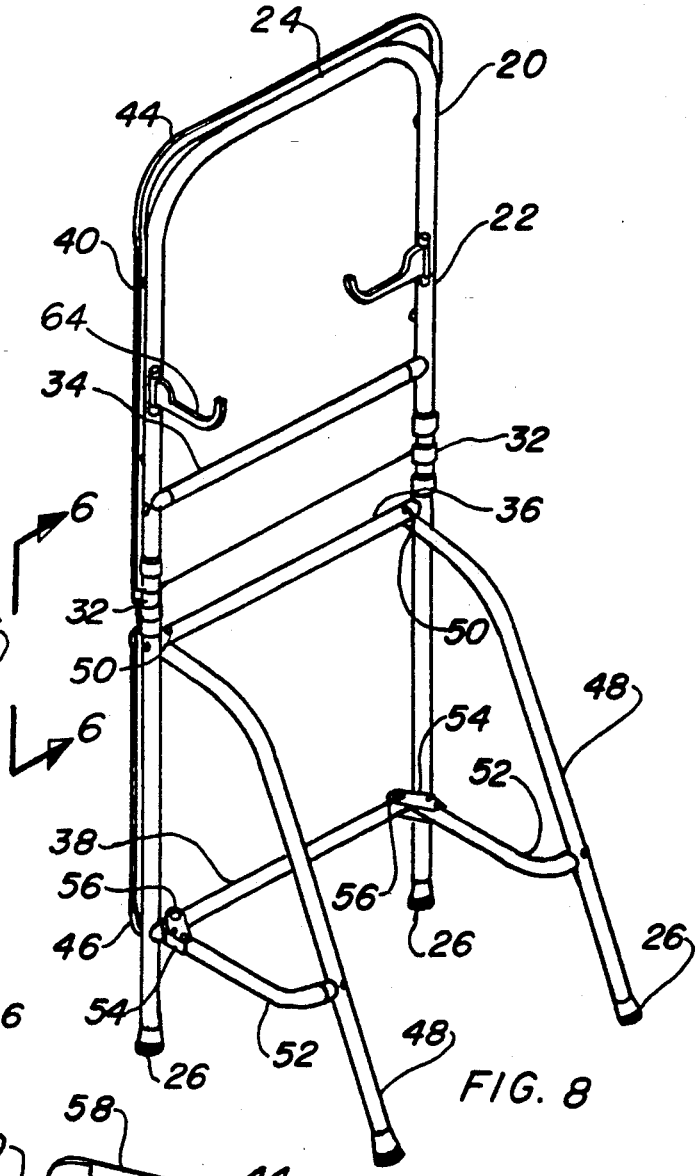
FIG. 8 is a partial isometric view of the preferred embodiment viewed from the rear.

The frame 20 is strengthened by the addition of a plurality of cross bars each connected on the ends to the vertical sides 22 as shown in FIG. 8. These bars include an upper cross bar 34, a middle cross bar 36 and a lower cross bar 38 with the upper bar 34 above the hinge means and the other two below providing structure to the frame when in either the extended or folded position. Both the frame 20 and cross bars 34, 36 and 38 are preferably hollow aluminum tubing with hardware and interface connections joining the elements together. The latter components are in common use and well known in the art and the material for the frame and cross bars is preferably made of aluminum tubing. However, any type of material such as plastic or steel having sufficient structural integrity for the purpose at hand may be used.

A mirror 40 is attached to the frame 20 as depicted in FIG. 1 and is large enough in size for the golfer to view himself during the complete swing of a golf club. The size is of importance as the mirror 40 is placed approximately 2 feet (0.6 meters) from the user to allow complete definition and to observe details as the invention allows one to find faults and deficiencies that can only be detected by careful and close observation. To assist the user in aligning his body properly, a series of marks in the form of lines 42 are included in the mirror 40. These marks 42 are horizontal and vertical and in corresponding locations for the golfer to observe his shoulders, hips, back and head alignment. The mirror 40 is divided into pieces, an upper half 44 and a lower half 46, permitting the invention to be folded in half thereby retaining only half of its height when collapsed for handling and storage. In order to be lightweight and rugged, the mirror 40 is preferably made of a thermoplastic or thermoset material such as clear acrylic with a reflective coating on one side. Other materials may work equally well such as polycarbonate, polystyrene, polysulfone and polyester (PET).

Figure 2:
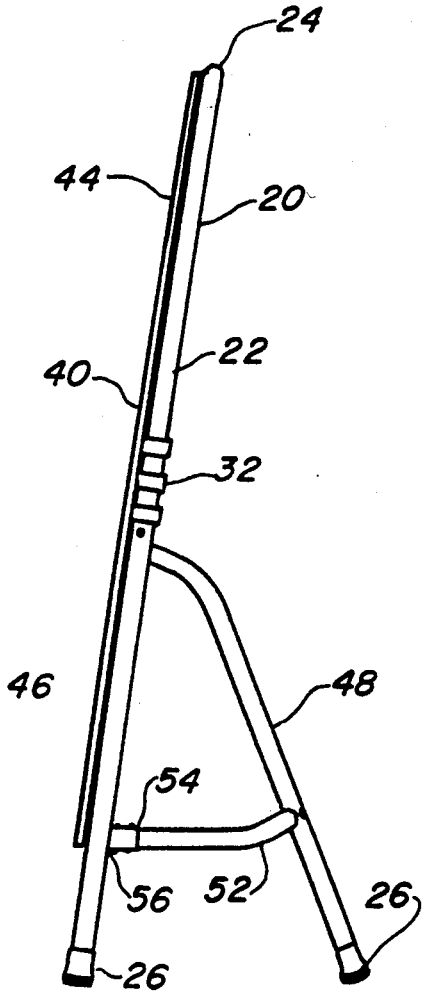
FIG. 2 is a right side elevation view of the preferred embodiment in its open position.
Figure 7:
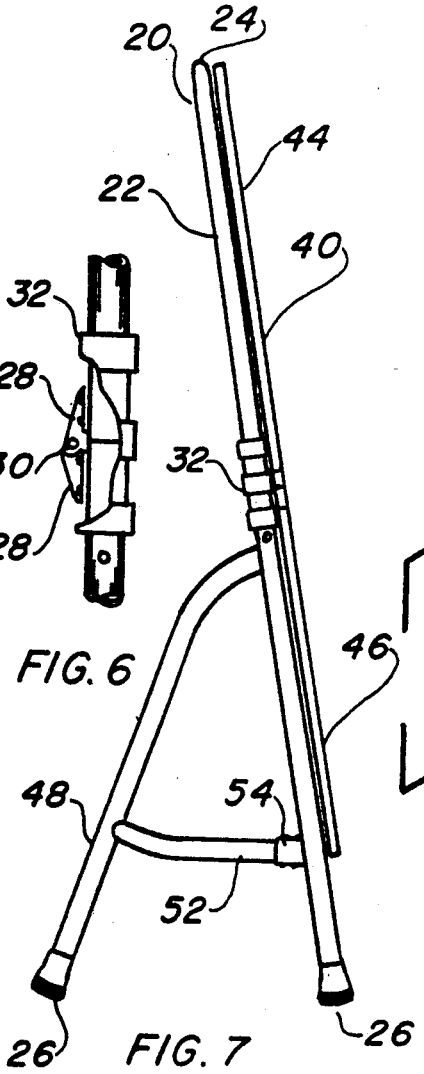
FIG. 7 is a left side elevation view of the preferred embodiment in its open position.

A retracting leg 48 is rotatably joined to each of the support legs 22 providing a four point mount for the mirror apparatus allowing it to stand by itself on a flat surface. The retracting legs are straight with a slight radius bend at the upper end as shown in FIGS. 2 and 7 permitting them to be pivotally joined to the support leg 22 just below the junction of the halves of the mirror 40. Pivot means for the junction consist of a washered structural rivet 50 inserted into a hole in each of the joining members as the retracting leg 48 is positioned directly below the middle cross bar 36 of the frame 20 as depicted in FIG. 8.

Each retractable leg 48 includes a support bar 52 attached between the leg 48 and the lower portion of the frame 20. The attachment also swivels using a channel shaped hinge bracket 54 and a second washered structural rivet 56, with the rivet 56 penetrating the frame lower cross bar 38 and the bracket 54. This joint is illustrated by itself in FIG. 4 and also in place in FIGS. 3 and 8.

Both of the legs 48 and support bars 52 are preferably made of hollow aluminum tubing however, as with the balance of the frame, other materials may be used with equal ease. Rubber tips 26 are added to the exposed ends for stability on the surface and to cover the open end of the leg 48.

Figure 9:
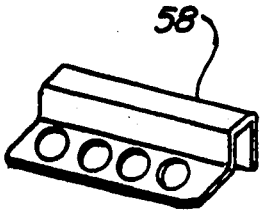
FIG. 9 is a isometric view of the ball tray completely removed from the invention for clarity.
Figure 10:
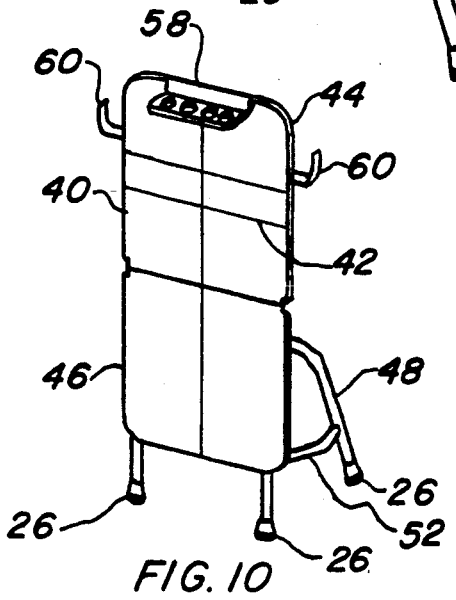
FIG. 10 is a isometric view of the preferred embodiment with the optional accessories in place.

Optionally a ball tray 58, shown individually in FIG. 9 and attached in FIG. 10, may be included in the invention. The tray 58 is preferably the configuration illustrated, however, the shape may change and the number of balls held may vary, not straying from the intent of the invention. The ball tray 58 is for convenience of ball storage for golfer when practicing their swing in front of the mirror apparatus.

Figure 11:
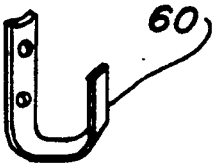
FIG. 11 is a isometric view of the golf bag hook completely removed from the invention for clarity.

Again, at the option of the user, one or more hooks 60 may be attached to the invention for supporting golf accessories such as golf bags during practice sessions in front of the mirror. FIGS. 10 and 11 illustrate such a hook and the location may be otherwise changed to optimize the convenience of holding a specific item. Alternatively, a pair of hinged cradles 64 sized to horizontally support a golf bag, may be attached to the backside of the support legs 22 as shown in FIG. 8. The hinges allow the cradles to be folded inwardly when not in use as shown, with one of the cradles in FIG. 8.

Figure 3:
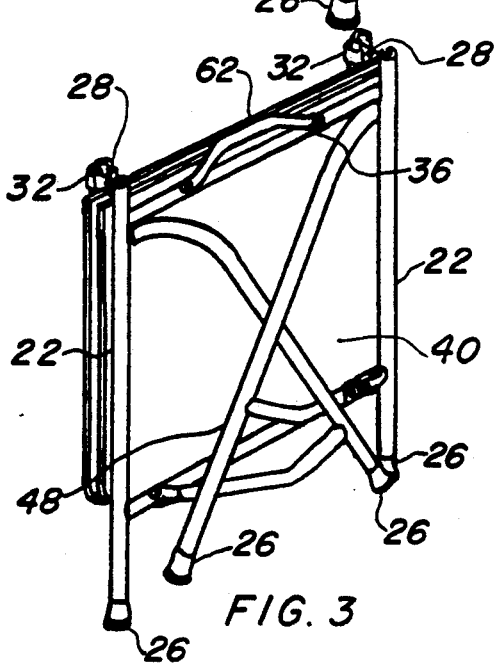
FIG. 3 is a partial isometric view of the preferred embodiment in its folded position for transportation and storage.
Figure 4:
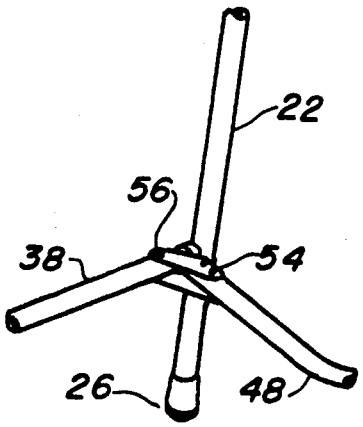
FIG. 4 is a fragmentary view in isometric illustrating the pivot means on the retracting legs.
Figure 5:
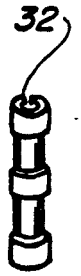
FIG. 5 is a view of the sliding sleeve for retaining the frame hinge means completely removed from the invention for clarity.
Figure 6:
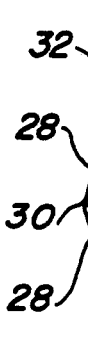
FIG. 6 is a view taken along lines 6—6 of FIG. 8.

Finally, a handle 62 may be added, if desired, to assist the golfer in carrying the apparatus to and from the area of use. The preferred location of this handle 62 is illustrated in FIG. 3 and may be attached to the middle or upper cross bar 36 or 34 as desired.

The use of the invention is intuitively obvious as the device is simply placed on the ground and the retracting legs 48 are rotated outward to form a stand. The upper half 44 of the mirror 40 is then pivoted upward and each sleeve 32 slid down over the joint. The golfer stands in front of the mirror for complete observation of his or her swing.

While the invention has been described in complete detail and pictorially shown in the accompanying drawings, it is not to be limited to such details, since many changes and modifications may be made in the invention without departing from the spirit and the scope thereof. Hence, it is described to cover any and all modifications and forms which may come within the language and scope of the claims.

We claim:

1. A portable mirror apparatus for golfing practice comprising:

a) a u-shaped frame having vertical sides forming two support legs with a horizontal top connected therebetween, also hinge means contained integrally with each vertical side permitting folding the frame in the middle for transportation and storage, b) a plurality of cross bars having ends, with each end connected to the vertical sides of the u-shaped frame for structural stability, c) a mirror, marked with lines, affixed to the frame large enough to permit golfers to view their entire body during the swing of a golf club, said mirror having an upper half and a lower half allowing the apparatus to be folded in half retaining only a portion of its height for convenience in handling, and d) a retracting leg pivotally joined to each of the support legs of the frame providing stability of the apparatus when placed on a flat surface.

2. The mirror apparatus as recited in claim 1 further comprising rubber tips on the frame support legs and retaining legs providing a non-slip surface for the apparatus when in use by the golfer during practice.

3. The mirror apparatus as recited in claim 1 wherein each frame hinge means further comprises a pair of leaves with a connecting pin and a sliding sleeve retained on the frame with the leaves attached to the vertical sides and the sleeve slipping thereover allowing the frame to be pivoted on the pin when the sleeve is slid away from the leaves.

4. The mirror apparatus as recited in claim 1 wherein said u-shaped frame comprises an aluminum hollow tube.

5. The mirror apparatus as recited in claim 1 wherein said plurality of cross bars further comprise an upper cross bar, a middle cross bar and a lower cross bar, the upper bar is connected between the legs on a portion above the hinge means and the middle and lower bars are disposed between a portion below the hinge means providing individual structural supports to both halves of the frame.

6. The mirror apparatus as recited in claim 1 wherein said cross bars further comprise hollow aluminum tubing having sufficient structural integrally to support the mirror.

7. The mirror apparatus as recited in claim 1 wherein said lines marked on the mirror further comprise horizontal lines and vertical lines with the lines indicating to the golfer the proper shoulder, hip and head alignment and to determine if their body maintains this posture during a swing.

8. The mirror apparatus as recited in claim 1 wherein said mirror is acrylic thermoplastic with a reflective surface on one side.

9. The mirror apparatus as recited in claim 1 wherein said pivotally joined retracting legs further comprise pivot means where the legs intersect with the frame, said pivot means comprise a first washered structural rivet jointly penetrating the frame and the retracting legs.

10. The mirror apparatus as recited in claim 9 wherein each retractable leg further comprises a support bar attached between the leg and the frame also including a channel shaped hinge bracket and a second washered structural rivet penetrating the frame and hinge bracket permitting the leg with the support bar to fold parallel with the frame.

11. The mirror apparatus as recited in claim 10 wherein said legs and support bars further comprise hollow aluminum tube having sufficient structural integrally to angularly support the apparatus when resting on a flat surface.

12. The mirror apparatus as recited in claim 1 further comprising a ball tray removably attached to the apparatus for storing golf balls.

13. The mirror apparatus as recited in claim 1 further comprising at least one hook attached to the apparatus for storing at least one golf accessories.

14. The mirror apparatus as recited in claim 1 further comprising a pair of hinged cradles attached to the backside of said support lets where said cradles are sized to horizontally support a golf bag.

15. The mirror apparatus as recited in claim 1 further comprising a handle for carrying the apparatus.

* * * * *